United States Patent [19]

Sugiyama et al.

[11] Patent Number: 4,574,878

[45] Date of Patent: Mar. 11, 1986

[54] PLATE FIN HEAT EXCHANGER FOR SUPERHIGH PRESSURE SERVICE

[75] Inventors: Yoshihiko Sugiyama; Teruo Uno; Hiroshi Irie, all of Nagoya; Teruo Kurachi; Tetsuo Abiko, both of Amagasaki, all of Japan

[73] Assignees: Sumitomo Light Metal Industries, Ltd., Tokyo; Sumitomo Precision Products Co., Ltd., Amagasaki, both of Japan

[21] Appl. No.: 469,549

[22] Filed: Feb. 25, 1983

[30] Foreign Application Priority Data

Mar. 10, 1982 [JP] Japan ..... 57-036506

[51] Int. Cl.[4] ..... F28F 3/06; F28F 21/08

[52] U.S. Cl. ..... 165/134.1; 165/166; 165/905

[58] Field of Search ..... 165/166, 134 R, 180, 165/DIG. 8, 152, 153

[56] References Cited

U.S. PATENT DOCUMENTS

| | | | |
|---|---|---|---|
| 3,878,871 | 4/1975 | Anthony et al. | 165/134 R |
| 3,960,208 | 6/1976 | Anthony et al. | 165/134 R |
| 4,209,059 | 6/1980 | Anthony et al. | 165/134 R |
| 4,317,484 | 3/1982 | Tanabe et al. | 165/134 R |
| 4,410,036 | 10/1983 | Kanada et al. | 165/134 R |

FOREIGN PATENT DOCUMENTS

| | | | |
|---|---|---|---|
| 2911295 | 10/1979 | Fed. Rep. of Germany | 165/134 R |
| 99597 | 7/1980 | Japan | 165/134 R |
| 95094 | 7/1980 | Japan | 165/134 R |

*Primary Examiner*—Sheldon J. Richter

*Attorney, Agent, or Firm*—Flynn, Thel, Boutell & Tanis

[57] ABSTRACT

A plate fin heat exchanger adapted to applications using superhigh-pressure fluids was fabricated by brazing, the heat exchanger using as fin stock an alloy consisting essentially of 0.3 to 1.0 wt. % Si, 0.05 to 0.25 wt. % Cu, 0.6 to 1.5 wt. % Mn and 0.45 to 0.9 wt. % Mg, the balance being aluminum and impurities, wherein said impurities contain up to 0.8 wt. % Fe.

At least one component selected from the group consisting of 0.05 to 0.25 wt. % Cr, 0.01 to 0.25 wt. % Ti, 0.03 to 0.25 wt. % Zr and 0.01 to 0.25 wt. % V may be added to the above fin alloy stock.

By using the above plate fin, excessive silicon diffusion from a brazing alloy into the fin, which may cause reduction of width of the brazed joint, is suppressed, and as a result, lowering of the bonding strength of the brazed joint is eliminated.

13 Claims, 4 Drawing Figures

PLATE FIN HEAT EXCHANGER FOR SUPERHIGH PRESSURE SERVICE

BACKGROUND OF THE INVENTION

The present invention relates to an improvement in a plate fin heat exchanger assembled integrally by brazing, wherein an aluminum alloy suppressing an excessive diffusion of silicon of brazing alloy into fins is used for a fin serving as a superhigh-pressure fluid passage.

Conventionally, AA3003 alloy with a good brazability has been extensively used as fin stock in plate fin heat exchangers fabricated by brazing using aluminum alloy. However, when fins are designed for use under a superhigh pressure of 55 kg/cm$^2$G or more, AA3003 alloy is inadequate as fin stock because of an insufficient tensile strength. Thus, under the such superhigh pressure, AA3004 alloy has been used instead of AA3003 alloy. AA3004 alloy has approximately one-half times higher strength than AA3003 alloy and a sufficient formability as fin stock.

Fins made of AA3004 alloy are normally brazed at a temperature of 580° to 610° C., using an aluminum-silicon brazing alloy containing, by weight, about 6.8 to 13% silicon. In fabricating heat exchangers of high density wherein fins having an increased plate thickness and corrugated at fine corrugation pitch are incorporated, it takes a very long time to preheat parts to be brazed and then heat uniformly all of them to the above brazing temperature. Thus, in brazed parts of the fin which reach the brazing temperature for a relatively short heating time, and are in contact with molten brazing alloy and then in the liquid-phase state for a long time, an unfavorable excessive diffusion of silicon contained in the brazing alloy into the fins is apt to occur. As a result of the excessive diffusion, the width of the brazed joint will be progressively reduced and bonding strength will be seriously decreased.

With respect to AA3004 alloy used as fin stock, it has been said that Mg contained in the fin in an amount of approximately 1 wt.% has a tendency to promote the diffusion of silicon in the brazing alloy into the fin.

BRIEF SUMMARY OF THE INVENTION

It is an object of the present invention to provide an improved fin stock suppressing the excessive silicon diffusion problem described above and having a combination of strength and formability well comparable to or superior to that of AA3004.

Another object of the present invention is to provide a plate fin heat exchanger for superhigh-pressure service incorporating the improved plate type fins wherein damage of brazed joints caused by the silicon diffusion set forth above is eliminated by using the above fin stock.

In accordance with the present invention, an improved heat exchanger particularly, but not exclusively, adapted for applications using superhigh-pressure fluids is fabricated by brazing, using plate type fins made of an aluminum alloy consisting essentially of 0.3 to 1.0 wt.% Si, 0.05 to 0.25 wt.% Cu, 0.6 to 1.5 wt.% Mn, and 0.45 to 0.9 wt.% Mg, the balance being aluminum and impurities, the impurities containing up to 0.8 wt.% Fe. Further, in addition to the above composition, the alloy of the present invention may contain at least one component selected from the group consisting of 0.05 to 0.25 wt.% Cr, 0.01 to 0.25 wt.% Ti, 0.03 to 0.25 wt.% Zr and 0.01 to 0.25 wt.% V.

The fin stock according to the invention exhibits a surprising effect in prevention of the excessive diffusion of silicon of the brazing metal into the fins during brazing and, further, is well comparable to or superior to AA3004 in strength and formability.

DETAILED DESCRIPTION OF THE PREFERRED EMBODIMENTS

Figure 1:
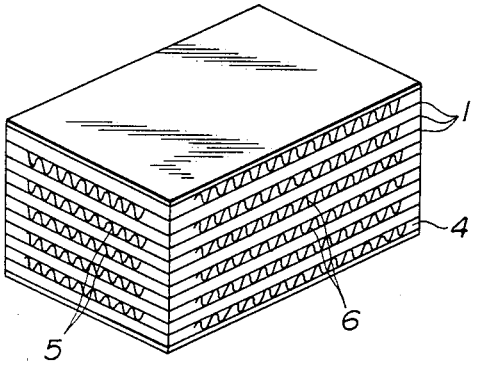
FIG. 1 is a perspective view showing a small-sized test assembly incorporating plate fins according to the present invention.

As mentioned above, the present invention provides a heat exchanger usable under superhigh pressure wherein a specially controlled aluminum alloy is used as a fin stock. In accordance with the first embodiment of the invention, there is provided an aluminum alloy fin stock consisting essentially of 0.3 to 1.0 wt.% Si, 0.05 to 0.25 wt.% Cu, 0.6 to 1.5 wt.% Mn and 0.45 to 0.9 wt.% Mg, and the balance being Al and impurities, wherein the impurities contain up to 0.8 wt.% Fe. Also, in the second embodiment of the invention, in addition to the alloy composition of the first embodiment, the alloy fin stock contains at least one element selected from the group consisting of 0.05 to 0.25 wt.% Cr, 0.01 to 0.25 wt.% Ti, 0.03 to 0.25 wt.% Zr and 0.01 to 0.25 wt.% V.

In practicing the present invention, the composition limits of the aluminum alloy fin stock described above must be closely followed in order to achieve the objects contemplated by the invention.

The function of each component and the reason why each component is limited to the aforesaid content range are described below.

Si has an effect of increasing strength in combination with Mg and, further, since Si in the fin reduces the Si concentration gradient between the fin and the brazing alloy, an excessive diffusion of Si contained in a brazing alloy into the fin is suppressed. When Si is present in an amount of less than 0.3 wt.%, the above effects will not be attained. On the other hand, with Si of more than 1.0 wt.%, melting point is decreased to an unacceptable level.

Cu has an effect of improving strength. However, when a content of Cu is less than 0.05 wt.%, the effect cannot be achieved. On the other hand, Cu in a content of more than 0.25 wt.% lowers corrosion resistance and brazability.

Mn has an effect of improving not only strength and corrosion resistance, but also brazability. Mn in an amount of less than 0.6 wt.% will not achieve sufficiently the effect. On the other hand, with a content of Mn than 1.5 wt.%, an unfavorable giant Al-Mn type compound is formed, causing the lowering of rolling workability which makes fabrication of fins difficult.

Mg is an essential component to increase strength to a required level. However, when a content of Mg is less than 0.45 wt.%, the effect cannot be achieved, while Mg in a content of more than 0.9 wt.% reduces remarkably the concentration of Si in the brazing alloy to form $Mg_2Si$ with Si in brazing alloy, lowering brazability.

Fe is an impurity and an excess content should be avoided. However, Fe of 0.8 wt.% or less improves the strength and buckling resistance at elevated temperatures.

By using the foregoing aluminum alloy as a fin stock, there is readily provided the heat exchanger adapted to a superhigh pressure service which has a high strength well comparable to or superior to the heat exchangers employing the fin made of AA3004 alloy and excellent brazed joints due to a good brazability.

In the second embodiment of the present invention, in addition to the above composition of the first embodiment, an alloy fin stock further contains at least one element selected from the group of 0.05 to 0.25 wt.% of Cr, 0.01 to 0.25 wt.% of Ti, 0.03 to 0.25 wt.% of Zr and 0.01 to 0.25 wt.% of V.

Cr and V have an effect of improving strength in the above specified content range. When contents of these components are below the limits set forth above, the effect will not be obtained. On the other hand, Cr and V in amounts of more than the upper limits form giant compounds and result in defective fin stock.

Ti has an effect on refinement of the structure of the ingot and increases the strength. However, when Ti is less than 0.01 wt.%, the effects cannot be obtained. On the other hand, Ti of more than 0.25 wt.% will cause surface defects of the aluminum alloy fin stock.

Zr has an effect of improving strength, more particularly, the strength at elevated temperature, and buckling resistance. Particularly, the effect is very important to fin stock being heated at a temperature near but below the melting point of the fin stock under the application of a load. When the content of Zr is less than 0.03 wt.%, the effect will not be achieved, and when the content exceeds 0.25 wt.%, undesirable giant intermetallic compounds are formed during casting, lowering the properties of the fin stock.

In the second embodiment of the present invention, the high strength (tensile strength of 16 kg/mm$^2$ or higher) and a formability sufficient for forming into fins are achieved by adding at least one element selected from the group consisting of the above-mentioned components, that is, Cr, V, Ti and Zr, to the composition of the first embodiment, without any lowering of corrosion resistance and brazability. Further, the elements of the second embodiment, Cr, V, Ti and Zr, serve to suppress excessive silicon diffusion of brazing material in the state of the liquid phase into the fin, and eliminate the decrease of the strength in brazed joints caused by long brazing time as in the case of the conventional fin stock.

In order to understand the present invention further and advantages derived therefrom, the following examples are described. In Table 1, alloy compositions for fin stocks according to the present invention are shown together with alloy compositions for comparison not containing Cu which is an essential component for the composition of the present invention.

TABLE 1

| | Chemical Composition (wt. %) | | | | | | | | | |
|---|---|---|---|---|---|---|---|---|---|---|
| No. | Si | Cu | Mn | Mg | Cr | Ti | Zr | V | Fe | Al |
| 1 | 0.89 | 0.22 | 0.82 | 0.68 | <0.01 | 0.01 | <0.01 | <0.01 | 0.24 | Bal. |
| 2 | 0.75 | 0.15 | 0.95 | 0.73 | " | " | " | " | " | " |
| 3 | 0.7 | 0.15 | 1.15 | 0.64 | " | " | " | " | 0.35 | " |
| 4 | 0.5 | 0.20 | 1.3 | 0.52 | " | " | " | " | " | " |
| 5 | 0.66 | 0.18 | 1.2 | 0.75 | " | " | " | " | 0.40 | " |
| 6 | 0.43 | 0.10 | 1.4 | 0.82 | " | " | " | " | 0.20 | " |
| 7 | 0.66 | 0.24 | 1.2 | 0.7 | " | " | " | " | 0.38 | " |
| 8 | " | " | " | 0.65 | 0.08 | " | " | " | 0.40 | " |
| 9 | " | " | " | " | <0.01 | " | 0.08 | " | " | " |
| 10 | " | " | " | " | " | 0.05 | <0.01 | " | " | " |
| 11 | 0.75 | 0.20 | 1.1 | 0.78 | " | <0.01 | " | 0.10 | " | " |
| 12 | " | " | " | " | 0.10 | " | 0.08 | <0.01 | " | " |
| 13 | " | " | " | " | 0.09 | " | <0.01 | 0.08 | " | " |
| 14 | " | " | " | " | <0.01 | 0.05 | 0.08 | <0.01 | " | " |
| 15 | 0.60 | " | 1.3 | 0.50 | " | <0.01 | 0.10 | 0.08 | " | " |
| 16 | " | " | " | " | 0.08 | 0.05 | 0.07 | <0.01 | " | " |
| 17 | " | 0.15 | " | " | 0.07 | <0.01 | 0.09 | 0.08 | " | " |
| 18 | " | " | " | " | " | 0.05 | 0.08 | 0.07 | " | " |
| 19 | 0.5 | <0.01 | 1.2 | 0.6 | <0.01 | 0.01 | 0.15 | <0.01 | 0.33 | " |
| 20 | 0.8 | " | 1.1 | 0.4 | " | " | <0.01 | 0.07 | 0.28 | " |

Figure 2:
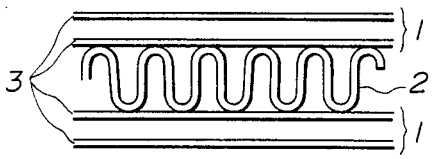
FIG. 2 is an elevational view showing a characteristic portion of the test assembly of FIG. 1.

Notes
Nos. 1-18 Alloys according to the present invention
Nos. 19-20 Alloys for comparison Small-sized test assemblies of the plate fin type heat exchanger shown in FIGS. 1 and 2 were prepared using plate type fins made of the alloys in Table 1. FIG. 1 shows a perspective view of the test assembly and FIG. 2 shows an elevational view of an important part. In preparation of the test assembly, plate type fin 2, which had a corrugation height of 6.35 mm, a plate thickness of 0.61 mm and a perforation rate 2.5%, and had eighteen fins per inch, was brazed between separator plates 1 made of brazing sheet having brazing alloy layer 3 under the brazing conditions of a flux temperature of 595° C. and a dipping period in flux of 120 minutes. Reference numerals 4, 5 and 6 designate a spacer bar, a test fluid passage and a dummy fluid passage, respectively. After fabricating each test assembly by flux dip brazing, rupture resistance owing to internal pressure was examined and the results are indicated in Table 2. Also, for comparison, a test heat exchanger using AA3004 alloys as fin stock was tested and the results are also indicated in Table 2.

TABLE 2

| Fin Stock (Alloy No.) | Rupture Pressure (kg/cm$^2$ G) | First Ruptured Portion |
|---|---|---|
| 1 | 526 | Fin |
| 2 | 518 | " |
| 3 | 518 | " |
| 4 | 522 | " |
| 5 | 520 | " |

TABLE 2-continued

| Fin Stock (Alloy No.) | Rupture Pressure ($kg/cm^2$ G) | First Ruptured Portion |
|---|---|---|
| 6 | 525 | " |
| 7 | 520 | " |
| 8 | 522 | " |
| 9 | 520 | " |
| 10 | 524 | " |
| 11 | " | " |
| 12 | 526 | " |
| 13 | 528 | " |
| 14 | " | " |
| 15 | " | " |
| 16 | " | " |
| 17 | 530 | " |
| 18 | 535 | " |
| 19 | 460 | Brazed Joint |
| 20 | 464 | " |
| AA3004 | 450 | " |

As is clear from the above results, in the case of the present invention, brazed joints of test assemblies all have a very high rupture resistance beyond rupture resistance of fins, and, thus, ruptures firstly occurred in the fins.

Figure 3:
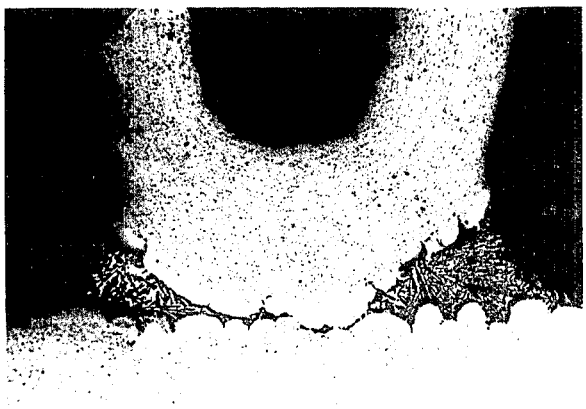
FIG. 3 is a microphotograph magnifying fifty times a microstructure of a brazed joint portion between brazing alloy and fin according to the present invention.
Figure 4:
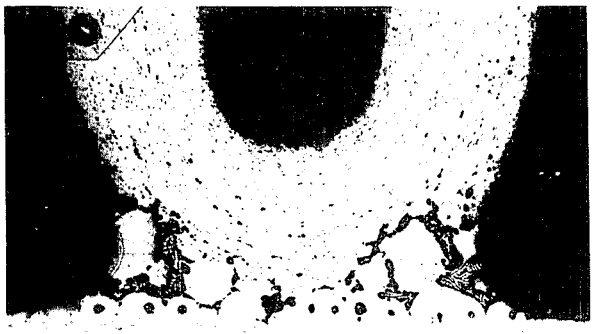
FIG. 4 is a microphotograph magnifying fifty times a microstructure of a brazed joint portion between brazing alloy and a comparative fin.

Further, the state of diffusion of silicon contained in the brazing alloy into the fins was examined on the test assembly utilizing the fins prepared from fin stock of alloy No. 18 by using a microscope and a photomicrograph of 50 magnifications shown in FIG. 3 was obtained. As shown in FIG. 3, a desirable microstructure in which silicon of the brazing alloy diffused temperately into the fins were obtained. However, in the case of utilizing AA3004 alloy as fin stock, as shown in FIG. 4, silicon of the brazing alloy excessively diffused into the fin.

In the fabrication of a practical heat exchanger, brazing requires more time than the case of the fabrication of the above test assembly, and, thus, the diffusion of silicon will be more markedly observed.

From the foregoing examples, it will be clear the heat exchanger according to the present invention has a very high strength in both brazed joints and fin part compared with the conventional heat exchanger utilizing AA3004. Thus, according to the present invention, there is provided heat exchanger having a higher pressure resistance than the conventional heat exchanger and the high rupture pressure of the present invention exceeding 500 $kg/cm^2G$ made possible the production of a high pressure-resistance heat exchanger usable in applications under superhigh-pressure.

What is claimed is:

1. In a brazed-plate-fin heat exchanger for use in a superhigh pressure service and comprising a corrugated fin disposed between two metal sheets and attached thereto by brazing, the improvement which comprises: said fins is made of an alloy consisting essentially of 0.3 to 1.0 wt.% Si, 0.05 to 0.25 wt.% Cu, 0.6 to 1.5 wt.% Mn, 0.45 to 0.9 wt.% Mg, up to 0.8 wt.% Fe, and balance being aluminum and impurities said alloy being free of calcium and tin.

2. In a brazed-plate-fin heat exchanger for use in a superhigh pressure service and comprising a corrugated fin disposed between two metal sheets and attached thereto by brazing, the improvement which comprises: said fin is made of an alloy consisting essentially of 0.3 to 1.0 wt.% Si, 0.05 to 0.25 wt.% Cu, 0.6 to 1.5 wt.% Mn, 0.45 to 0.9 wt.% Mg, up to 0.8 wt.% Fe, and at least one component selected from the group consisting of 0.05 to 0.25 wt.% Cr, 0.01 to 0.25 wt.% Ti, 0.03 to 0.25 wt.% Zr and 0.01 to 0.25 wt.% V, the balance being aluminum and impurities said alloy being free of calcium and tin.

3. A heat exchanger as claimed in claim 2, wherein said alloy contains at least two of said components.

4. A heat exchanger as claimed in claim 2, wherein said alloy contains at least three of said components.

5. A heat exchanger as claimed in claim 2, wherein said fin stock material consists of Si, Cu, Mn, Mg, Fe and Cr, the balance being aluminum and unavoidable impurities.

6. A heat exchanger as claimed in claim 2, wherein said fin stock material consists of Si, Cu, Mn, Mg, Fe and Ti, the balance being aluminum and unavoidable impurities.

7. A heat exchanger as claimed in claim 2, wherein said fin stock material consists of Si, Cu, Mn, Mg, Fe and Zr, the balance being aluminum and unavoidable impurities.

8. A heat exchanger as claimed in claim 2, wherein said fin stock material consists of Si, Cu, Mn, Mg, Fe and V, the balance being aluminum and unavoidable impurities.

9. A heat exchanger as claimed in claim 2, wherein said alloy consists of approximately 0.6 wt.% Si, 0.15 wt.% Cu, 1.3 wt.% Mn, 0.5 wt.% Mg, 0.07 wt.% Cr, less than 0.01 wt.% Ti, 0.09 wt.% Zr, 0.08 wt.% V, 0.4 wt.% Fe, and the balance is aluminum.

10. A heat exchanger as claimed in claim 2, wherein said alloy consists of approximately 0.6 wt.% Si, 0.15 wt.% Cu, 1.3 wt.% Mn, 0.5 wt.% Mg, 0.07 wt.% Cr, 0.05 wt.% Ti, 0.08 wt.% Zr, 0.07 wt.% V, 0.4 wt.% Fe, and the balance is aluminum.

11. In a brazed-plate-fin heat exchanger for use in a superhigh pressure service and comprising a corrugated fin disposed between two metal sheets and attached thereto by brazing, the improvement which comprises: said fin is made of an alloy which consists of 0.43 to 0.89 wt.% Si, 0.10 to 0.24 wt.% Cu, 0.82 to 1.4 wt.% Mn, 0.5 to 0.82 wt.% Mg, 0.2 to 0.4 wt.% Fe, and at least one element selected from the group consisting of 0.07 to 0.1 wt.% Cr, 0.01 to 0.05 wt.% Ti, 0.08 to 0.1 wt.% Zr and 0.07 to 0.1 wt.% V, the balance being aluminum and unavoidable impurities said alloy being free of calcium and tin.

12. A heat exchanger as claimed in claim 11, wherein said alloy contains at least two of said components.

13. A heat exchanger as claimed in claim 11, wherein said alloy contains at least three of said components.

* * * * *